US005404740A

United States Patent [19]

Okada et al.

[11] Patent Number: 5,404,740

[45] Date of Patent: Apr. 11, 1995

[54] HIGH-RIGID TYPE GUIDING METHOD FOR STEEL MATERIALS TO BE ROLLED

[75] Inventors: Shoji Okada; Atsumu Nakamura; Hideo Kunioku; Kenji Shibuya; Satoshi Kubota; Koichi Inamura; Haruotsu Ikeda; Takaya Suzuki; Kyouhei Murata, all of Sapporo, Japan

[73] Assignee: Kotobuki Sangyo Kabushiki Kaisha, Sapporo, Japan

[21] Appl. No.: 79,114

[22] Filed: Jun. 17, 1993

[30] Foreign Application Priority Data

Jan. 28, 1993 [JP] Japan ..... 5-031169

[51] Int. Cl.[6] ..... B21B 1/18; B21B 39/16

[52] U.S. Cl. ..... 72/250

[58] Field of Search ..... 72/250, 251, 428

[56] References Cited

U.S. PATENT DOCUMENTS 3,330,143 7/1967 Washburn ..... 72/250
4,790,164 12/1988 Rothe ..... 72/250

FOREIGN PATENT DOCUMENTS 58-77709 5/1983 Japan .
1572557 7/1980 United Kingdom ..... 72/251

OTHER PUBLICATIONS

"Principles of Continuous Gauge Control in Sheet and Strip Rolling", W. C. F. Hessenberg et al., Research on the Rolling Strip, A Symposium of selected papers, 1948–1958, pp. 185–191.

*Primary Examiner*—Lowell A. Larson
*Assistant Examiner*—Thomas C. Schoeffler
*Attorney, Agent, or Firm*—Jordan and Hamburg

[57] ABSTRACT

A high-rigid type guiding device for guiding a steel material to be rolled comprises guide rollers toughened by satisfying the condition in which rigidity (K) at contact portions with the steel material is defined by:

$$K = Fmax/Smax$$

wherein, Fmax represents the maximum load exerted on the guide rollers ($Fmax = m \times FT$, $1.0 \leqq m \leqq 2.0$), and Smax represents the maximum allowable value within a range in which increment S of a roller gap defined between the contact portions is determined ($Smax = n \times \delta 1$, $0.2 \leqq n \leqq 0.8$). Consequently, the efficiency of rolling and the productivity of the rolled steel products can be improved, and the yielding efficiency and quality of the products can be heightened.

1 Claim, 3 Drawing Sheets

(Increment of nip space : dimensionless)

(Increment of nip space : dimensionless)

HIGH-RIGID TYPE GUIDING METHOD FOR STEEL MATERIALS TO BE ROLLED

BACKGROUND OF THE INVENTION

1. Field of the Invention

This invention relates to a method and device for guiding steel material to be rolled into a rolling mill machine for producing rolled steel products of various shapes such as wire rods, steel bars and H-section beams. More particularly, this invention relates to a method capable of making a more stiff steel material guiding device applicable to a low temperature hot rolling, high speed rolling and high load rolling for special steel, which have spread in the art tending to increase the load exerted on the steel material guiding device.

2. Description of the Prior Art

Conventionally, there have been known various types of steel material guiding devices such as of a roller guide type and a friction guide type. For instance, the conventional roller guide type guiding device shown in FIG. 3 comprises a pair of roller holders 1 having guide rollers 2 for guiding a steel material 3 to be rolled. The roller gap defined between the guide rollers 2 can be adjusted in accordance with the dimension of the steel material 3 by actuating a cylinder 4 to rotate the roller holders 1 about pivots 5, respectively.

On the present technological level in the art, the roller guide type steel material guiding device is essential for rolling rod, wire, bar and other section steel and has a long history. However, information data of actually measured data of a load which is exerted on the guide rollers when guiding ordinary steel materials to be rolled have not been disclosed at all. Furthermore, the load exerted on the guide rollers has never been systematically studied nor practically taken into consideration in guiding the steel materials to be rolled. That is to say, the design and use of the roller guide type guiding device have generally progressed in dependence on the experience of engineers skilled in the art.

The aforenoted load generated in the steel material guiding device may be summarized as follows:

The load F exerted on the guide roller in the steel material guiding device is increased up to the maximum load value FT which is obtained by calculating backwards the entire plastic torque T (theoretical value) determined in accordance with the sectional shape, size and resistance to deformation of steel materials to be rolled. The load F has been so far considered about 20% to 60% of the maximum load value FT as a matter of fact. Thus, it was thought that the guide roller type guiding device capable of tolerating the load of such a degree is sufficient and accordingly may be formed of a flexible structure. Under the existing circumstances, the idea of increasing the "rigidity" of the roller guide type guiding device has been scarcely allowed for up to now.

Nothing but Japanese Utility Model Post-examination Publication No. SHO 61-1929 discloses the "rigidity" of the roller guide type steel material guiding device. However, the technical idea of determining the most suitable increment of the roller gap formed between the guide rollers relative to the load exerted on the guide rollers is mentioned nowhere in the aforenoted Japanese publication and any other references so far published.

In recent years, the high-load rolling technique such as of a high-speed and/or low temperature hot rolling type has been advanced in order for achieving improvements in productivity, energy conservation, and rationalization of processing (e.g. adoption of an online process for heat treatment) in rolling steel materials and making high strength steel materials fit for practical use. Under such a severe condition of rolling, tilting of the steel material inevitably occurs frequently during the process of rolling and becomes a serious problem to be solved in the art of rolling.

The high quality rolled steel products having high accuracy in size and sectional shape and a faultless surface are strictly required of users today. Though the rolling mill machine has been improved so as to be made more stiff, thus markedly increasing the quality of the rolled steel products, the roller guide type guiding device has made little progress and still suffered disadvantages of failure of rolling the steel material, occurrence of dimensional discontinuity and defects such as surface defects in the product obtained finally.

These disadvantages are caused by the low rigidity of the roller guide type guiding device having a relatively flexible structure, which is deemed to cause the steel material to tilt while traveling through the guiding device under pressure. Since the guiding device shown in FIG. 3 is formed of the flexible structure as noted above, the steel material 3 to be rolled is disadvantageously guided on the tilt when being nipped between the guide rollers 2 as illustrated in FIG. 4.

OBJECT OF THE INVENTION

An object of this invention is to provide a high-rigid type steel material guiding method and device capable of preventing a steel material to be rolled from tilting in the roller gap formed between guide means of the guiding device by lessening increment of the roller gap between the guide means relative to change of load exerted on the steel material so as to preclude the possibility of causing failure of rolling, dimensional discontinuity and surface defects of finally obtained products such as wire rods and section steels.

Another object of this invention is to provide a steel material guiding method capable of better advancing the technique of rolling the steel material for producing high quality rolled steel products.

SUMMARY OF THE INVENTION

To attain the objects described above according to this invention, there is provided a method for guiding a steel material to be rolled by use of guide means placed between rolling stands, which comprises determining rigidity (K) of the guide means at contact portions at which the steel material is in contact with the guide means, in accordance with the equation:

$$K = Fmax/Smax$$

wherein, Fmax represents the maximum load exerted on the guide means, and Smax represents the maximum allowable value within the range in which increment of the roller gap between the contact portions is determined.

The condition for Fmax is as follows:

$$\begin{aligned} Fmax &= m \times FT,\ 1.0 \leqq m \leqq 2.0 \\ &= m \times T/L \end{aligned}$$

wherein, FT is the load exerted on the guide means at the aforenoted contact portions, which is given by torque generated when guiding the steel material between the guide means, T is a theoretical value of an entire plastic torque determined according to the sectional shape and size of the steel material to be rolled and the rolling temperature, and L is a torque arm provided by the distance between the contact portions at which the steel material is in contact with the guide means.

The condition for Smax under the condition of Fmax is as follows:

$$Smax = n \times \delta 1,\ 0.2 \leqq n \leqq 0.8$$

wherein, δ1 is the increment of the roller gap between the contact portions just before the steel material to be rolled is completely inclined at 90° in the roller gap defined between the contact portions.

The condition of the maximum Fmax provided in the aforesaid condition for Smax signifies that the increment of the roller gap between the contact portions varies with the load F exerted on the contact portions and becomes Fmax at most. For example, where Fmax is 1.6·FT, Smax becomes 0.6·δ1.

Further, this invention provides a guiding device comprising guide means mounted between rolling stands for guiding the steel material to be rolled, in which the steel material is in contact with the guide means at the contact portions, and rigidity (K) of the guide means at the contact portions is defined by the aforesaid equation (K=Fmax/Smax), so that increment S of the roller gap between the contact portions is defined in the range of the aforesaid Smax under the condition of the aforesaid Fmax.

In brief, the steel material guiding method and device according to this invention have an effect of preventing the steel material guided between the guide means from tilting by satisfying the following three conditions:

Condition 1: $Fmax = m \times FT,\ 1.0 \leqq m \leqq 2.0$

Condition 2: $Smax = n \times \delta 1,\ 0.2 \leqq n \leqq 0.8$

Condition 3: $K = Fmax/Smax$

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The other objects and features of the present invention will be hereinafter explained in detail with reference to the accompanying drawings, wherein.

DESCRIPTION OF THE PREFERRED EMBODIMENTS

One embodiment of this invention will be described, in which a roller guide type steel material guiding device is discussed, by way of example.

To solve the disadvantage such that a steel material to be rolled tilts in the guiding device, it is necessary to elucidate the maximum value of load exerted on the guide rollers in the guiding device during rolling the steel material, and the width of the roller gap formed between the guide rollers just before the steel material is completely inclined at 90° in the roller gap between the guide rollers. Furthermore, these rolling data should be generalized to conform to various rolling conditions.

Figure 1:
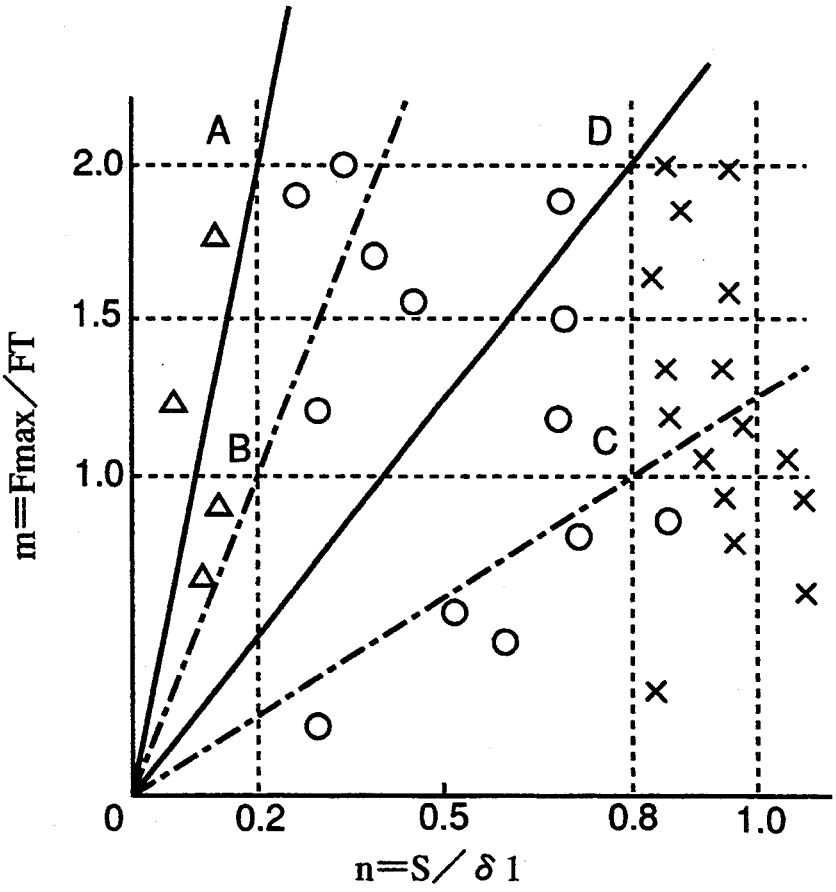
FIG. 1 is a graph representing the relation between coefficients (m and n)

Research of the maximum value of load exerted on the guide rollers as noted above which were conducted over a long period of time reveal that the condition of rolling a variety of steel materials is substantially satisfied by the following Equation (1). FIG. 1 depicts data obtained by the research, from which Equation (1) below can be evaluated.

$$Fmax/FT \leqq 2 \quad (1)$$

wherein Fmax represents the maximum load exerted on the guide rollers in the process of rolling the same steel material.

The term FT is the load exerted on the guide rollers, which is defined by the following Equation (2) using a theoretical value T of the entire plastic torque determined according to the geometrical sectional shape, size and resistance to deformation of the steel materials to be rolled.

$$FT = T/L \quad (2)$$

wherein L represents a torque arm (distance between the contact points at which the steel material to be rolled comes in contact with the guide rollers) determined in accordance with the sectional shape and size of the steel material and the shape and size of the roller gap formed between the guide rollers.

Figure 2:
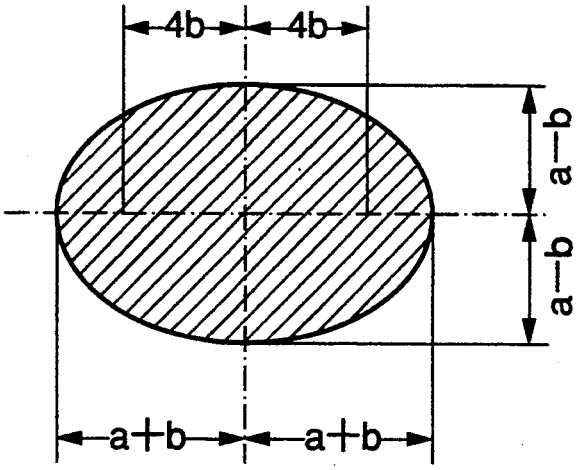
FIG. 2 is a sectional view showing a steel material having an oval section to determine geometrical variables (a and b)
Figure 3:
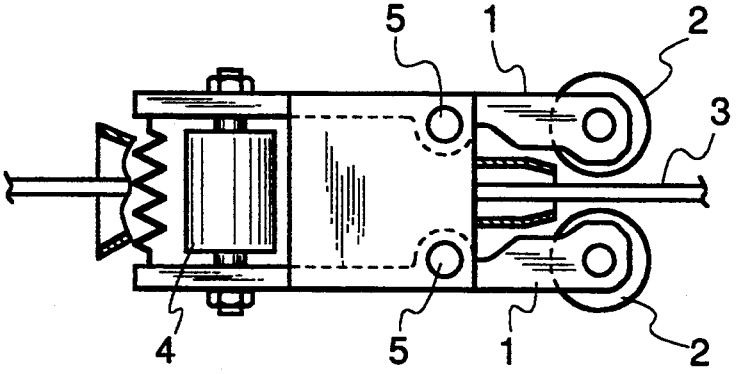
FIG.3 PRIOR ART
FIG. 3 is a plan view showing a conventional roller guide means.
Figure 4:
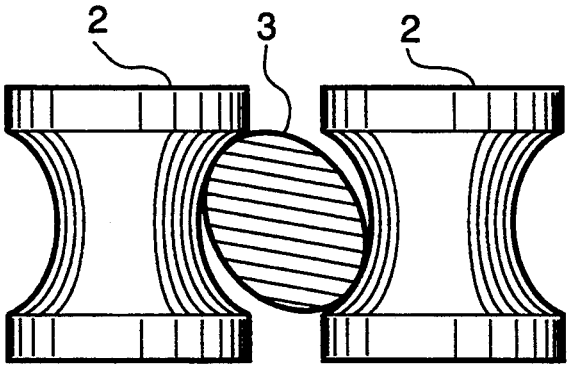
FIG.4 PRIOR ART
FIG. 4 is an enlarged front view of the steel material held between guide rollers in its inclined state.

As one example, the entire plastic torque T (theoretical value) of the steel material 3 having an oval section as shown in FIG. 2 is expressed as follows:

$$T = (\pi/3) \times kfm \times (a^3 - 4.5ab^2 + 4b^3) \quad (3)$$

wherein kfm represents two-dimensional average resistance to deformation at a temperature at which the steel material is rolled.

On the subject as to how the roller gap between the guide rollers just before the steel material is completely inclined at 90° is determined, the roller gap δ1 between the guide rollers can be determined by a construction method using, for example, a CAD system or other suitable construction methods. That is, the state in that the steel material is gradually inclined as the roller gap δ1 between the guide rollers is gradually widened can be depicted where the geometrical sectional shape and size of the steel material and the dimensional condition of the guide rollers are known.

As a result of the research in rigidity (Kold) between the guide rollers, it was found that, when the steel material begins to tilt in the roller guide device, the rigidity is included within the following range:

$$Kold < 1.25 \times FT/\delta 1 \quad (4)$$

By investigating the conditions for preventing the steel material from tilting and making trial constructions of the guiding devices one after the other, the rigidity design for the roller guide device of the invention could be established.

First, the condition for the maximum degree of the roller gap between the guide rollers, Smax, under the maximum value of the load, Fmax, exerted on the guide rollers in order for preventing the steel material from tilting can be defined as follows:

$$Smax = n \times \delta 1,\ 0.2 \leqq n \leqq 0.8 \quad (5)$$

There is a case that the steel material guided and nipped between the guide rollers is completely inclined at 90° when the coefficient (n) of the increment of the roller gap between the guide rollers, S, exceeds 0.8, thus possibly giving rise to failure of rolling. Therefore, the coefficient (n) of the roller gap increment (S) should be less than 0.8. When the coefficient (n) of the roller gap increment (S) is not greater than 0.2, there is a possibility that the rolled steel product may take surface defects under the following conditions.

The optimum value of the aforesaid coefficient (n) is determined in accordance with various rolling conditions such as the sort of steel materials to be rolled, rolling temperature, rolling speed, sectional shape and size of the steel material, and apertures formed in series in a rolling draw plate. However, in the experiences of the inventors, it is generally preferable that the optimum value be $0.2 \leqq n \leqq 0.5$. The technological meaning of the coefficient (n) is what degree the inclination (angle) of the steel material between the guide rollers should be permissible to in a rolling operation, and in this respect, rolling mills in respective companies have a different point of view for determining the optimum value.

Thus, the increment (S) of the roller gap formed between the guide rollers should be determined within the range defined by Equation (5) noted above.

Secondly, it was clear from the results of the research that the maximum value Fmax of the load which is exerted on the guide rollers when rolling various steel materials for a long time should be determined within the range defined by Equation (6) below:

$$Fmax = m \times FT,\ 1.0 \leqq m \leqq 2.0 \quad (6)$$

Therefore, the rigidity (K) of the guide rollers, with which the steel material can be prevented from tilting in the roller gap between the guide rollers in the roller guide device during the course of prolonged rolling process, is given:

$$K = Fmax/Smax \quad (7)$$

Though the ratio Fmax/FT and the optimum value of the coefficient (m) in Equation (6) are also determined in accordance with the rolling conditions in the rolling mill machine, it can be said from the experience of the inventors that the condition of $1.5 \leqq m \leqq 2.0$ is preferable from the standpoint of design.

Though the actual measurement value within the range of $0.6 \leqq m \leqq 1.0$ may be used for rolling ordinary steel materials at a normal temperature, the design measurement value within the range of $1.0 \leqq m \leqq 2.0$ is desirable. This is because the roller setting mechanism must be adjusted to cope with change of the rolling conditions and further remedy minute deviation of the guide rollers or other components in the rolling mill machine, which inevitably occurs during the course of prolonged rolling process, bringing about mismatch of adjustment to arrangement of rollers or roller guide in the rolling mill machine. Consequently, the excessive burden on the roller guide machine is increased.

FIG. 1 manifests the technical and design ideas of the roller guiding device according to the invention along with the effect of the invention. FIG. 1 shows the relation between the coefficient (m) and coefficient (n) where ordinary steel, special steel and stainless steel materials are respectively rolled into a rolled steel product at a normal or low temperature by use of a rolling draw plate having oval and round apertures in series under the condition that the roller gap δ1 between the guide rollers assumes approximately 2 mm just before the steel material is completely inclined at 90° . The mark ∘ in FIG. 1 means that no tilting of the steel material occurred, the mark × means that tilting of the steel material occurred, and the mark Δ means that the steel material took numerous surface defects.

Furthermore, FIG. 1 represents that the optimum coefficients (m) and (n) fall within the region surrounded by the intersection points (A, B, C, D) of two horizontal dotted lines of 1.0 and 2.0 in the dimensionless number (m=Fmax/FT) and two vertical dotted lines of 0.2 and 0.8 in the dimensionless number (n=S/δ1). That is, the grade of the line connecting a point within the aforesaid region to the origin signifies the desired minimum dimensionless rigidity.

Next, the rigidity of the roller guide device will be described.

The maximum value Fmax of load exerted on the roller guide device has been so far deemed as follows:

$$Fmax < FT \quad (8)$$

As the operation for rolling ordinary steel materials at a normal temperature was effected by the accumulated experience of an operator, the load exerted on the roller guide device was determined to 20% to 60% of the maximum load value FT as stated earlier on. For this reason, the roller guide device of a flexible structure being low in rigidity has been so far used.

However, not infrequently there are times when the steel material tilts in the roller guide device during the course of effecting the rolling operation under the severe condition for special steel materials at a normal temperature. To solve thoroughly this problem, this invention clearly introduces the "rigidity in the roller guide device" to provide a steel material guiding mechanism capable of preventing a steel material to be rolled from tilting as mentioned above.

First, the situation in that the load exerted on the roller guide device comes under the relation expressed by the following Equation (9) was confirmed with considerable frequency.

$$Fmax \geqq FT \quad (9)$$

The invention was made in the light of the aforesaid situations.

The reason why the maximum load Fmax exceeds FT is that load exerted on the roller guide device is caused by elastic deformation of the steel material placed between the guide rollers and cannot definitely be disregarded, and that when the steel material nipped between the guide rollers tilts in some degree, the steel material is somewhat plastically drawn with sustaining load. Thus, there has been a need for the roller guide device capable of withstanding the load.

Secondly, the requirement for preventing the steel material from being completely inclined at 90° in the roller guide device is defined as Equation (5), thus bringing about a revolution in the art and design of the roller guide device.

According to this invention taking measures to cope with the requirements noted above, there could be a newly developed "high-rigid type roller guide device" capable of preventing the steel material from tilting between the guide rollers, thus producing high quality rolled steel products having high accuracy in size and sectional shape and a faultless surface. This "high-rigid type steel material guiding method and device" according to this invention can be applied to a conventional rolling mill machine which is generally operated under an ordinary condition to bring about sufficient results of rolling.

The aforementioned high-rigid type steel material guiding method and roller guide device of the invention are applied for rolling various steel material under various conditions including a rolling temperature and rolling speed. Therefore, it is essential to decide the maximum value Fmax of the load exerted on the guide rollers from the extremities of the aforesaid conditions of rolling the steel materials as noted above. Moreover, the roller gap δ1 between the guide rollers is desirably determined as small as possible in the aforesaid conditions. Taking these conditions into consideration, sufficient rigidity (K) for the roller guide device can be adequately decided from Equation (7) noted above.

To be concrete, the roller guide device can be given sufficient rigidity by first stiffening the components of the device and improving the sectional shape and size of the components of the device, secondly applying prestress to the device, and thirdly widening the roller gap for accommodating the device between a rolling mill machine.

It is apparent that the technique and idea of designing the roller guide device according to this invention are by no means limitative and may be generally applied to a friction guide type steel material guiding device using no guide roller. In the friction guide type device, a sleeve guide means corresponds to the guide means for the steel material to be rolled in the roller guide type device. Furthermore, the steel materials to be rolled in this invention should not be understood as limitative.

According to this invention, the steel material traveling through the guiding device can be prevented from tilting in the roller gap between the guide rollers, so that various troubles of rolling the steel material such as failure of rolling, deterioration in the accuracy of the sectional shape and size of the rolled steel product and surface defects in the rolled steel product can be effectively obviated. As a result, the efficiency of rolling and the productivity of the rolled steel products can be improved, and the yielding efficiency and quality of the products can be heightened.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. In a high-rigid type guiding method for guiding a steel material to be rolled having various sectional shapes and sizes by use of guide means placed between rolling stands, the method comprising the steps of:

forming said guide means with contact portions at which said steel material is in contact with said guide means, and determining a rigidity (K) of said guide means at said contact portions, in accordance with the equation:

$$K = F\max / S\max$$

wherein, Fmax represents the maximum load exerted on said guide means, and is defined by:

$$F\max = m \times FT,\ 1.0 \leqq m \leqq 2.0$$
$$= m \times T/L$$

wherein, FT is the load exerted on said contact portions, which is given by torque generated when rolling said steel material to be rolled, T is a theoretical value of an entire plastic torque determined according to the sectional shape and size of said steel material and a rolling temperature, and L is a torque arm provided by a distance between the contact portions at which said steel material is in contact with said guide means, and Smax represents the maximum allowable value within a range in which increment of a roller gap defined between the contact portions is determined, and is defined under the condition of Fmax as follows:

$$S\max = n \times \delta 1,\ 0.2 \leqq n \leqq 0.8$$

wherein, δ1 is the increment of said roller gap between the contact portions just before the steel material is completely inclined at 90°.

* * * * *